US010947756B2

(12) United States Patent
VanMeter

(10) Patent No.: US 10,947,756 B2
(45) Date of Patent: Mar. 16, 2021

(54) ELECTROMECHANICAL LOCK WITH MECHANICAL LATCH HOLDBACK AND REMOTE RELEASE

(71) Applicant: R.R. Brink Locking Systems, Inc., Shorewood, IL (US)

(72) Inventor: Karl VanMeter, Joliet, IL (US)

(73) Assignee: R.R. BRINK LOCKING SYSTEMS, INC., Shorewood, IL (US)

( * ) Notice: Subject to any disclaimer, the term of this patent is extended or adjusted under 35 U.S.C. 154(b) by 446 days.

(21) Appl. No.: 15/976,338

(22) Filed: May 10, 2018

(65) Prior Publication Data

US 2018/0328080 A1 Nov. 15, 2018

Related U.S. Application Data

(60) Provisional application No. 62/504,338, filed on May 10, 2017.

(51) Int. Cl.
*E05B 63/18* (2006.01)
*E05B 47/06* (2006.01)
(Continued)

(52) U.S. Cl.
CPC ..... *E05B 63/18* (2013.01); *E05B 47/06* (2013.01); *E05B 47/0607* (2013.01);
(Continued)

(58) Field of Classification Search
CPC .... E05B 47/0012; E05B 47/02; E05B 47/026; E05B 47/06; E05B 47/0603;
(Continued)

(56) References Cited

U.S. PATENT DOCUMENTS 4,180,287 A 12/1979 Youngblood et al.
4,190,985 A 3/1980 Richards et al.
(Continued)

FOREIGN PATENT DOCUMENTS

BE 1013197 A3 10/2001
EP 0779404 B1 1/2004
(Continued)

OTHER PUBLICATIONS

Folger Adam; Folger Adam Detention Products Catalog; available online at http://www.southernfolger.com/Folger_Adam_Electric_Lock_Section.pdf; 2016.
(Continued)

*Primary Examiner* — Christopher J Boswell
(74) *Attorney, Agent, or Firm* — Clark Hill PLC; James R. Foley

(57) ABSTRACT

An electromechanical lock which is configured to provide a mechanical latch holdback feature, whereby a key is useable to retract a latch of the lock, the key can be removed, and the latch remains mechanically held back. The held back latch is remotely releasable. As such, a correctional officer can use his key to mechanically hold back the latch, such that the lock remains open. Subsequently, a control signal can be sent from a remote location causing the latch to be released and extended, such that the lock locks. This ability to remotely override the mechanical latch holdback is useful in a correctional facility—for example, when the mechanical latch holdback has been engaged for cell doors and an emergency situation arises where a quick remote lockdown may be necessary, instead of having to perform the time-consuming task of re-locking the doors one-by-one, locally by key.

32 Claims, 13 Drawing Sheets

(51) Int. Cl.
*E05B 65/00* (2006.01)
*E05B 47/00* (2006.01)

(52) U.S. Cl.
CPC ..... *E05B 47/0657* (2013.01); *E05B 63/185* (2013.01); *E05B 65/0017* (2013.01); *E05B 47/0012* (2013.01); *E05B 2047/0048* (2013.01); *E05B 2047/0067* (2013.01); *E05B 2047/0084* (2013.01); *E05B 2047/0094* (2013.01)

(58) Field of Classification Search
CPC ..... E05B 47/0607; E05B 47/0611; E05B 47/0657; E05B 47/0661; E05B 47/0665; E05B 47/0669; E05B 2047/0037; E05B 2047/0084; E05B 2047/0085; E05B 2047/0094; E05B 63/18; E05B 63/185; E05B 65/0017; E05B 2047/0048; E05B 2047/0067
See application file for complete search history.

(56) References Cited

U.S. PATENT DOCUMENTS 4,509,347 A 4/1985 Young
4,621,451 A 11/1986 Bruehler
4,679,416 A 7/1987 Kambic
4,685,709 A 8/1987 Kambic
4,872,284 A 10/1989 Bentley
4,929,003 A 5/1990 McConnell
4,982,528 A 1/1991 Michel
4,993,757 A 2/1991 Corzine
5,299,385 A 4/1994 McConnell
5,492,382 A 2/1996 McBride et al.
5,566,991 A 10/1996 Young
5,646,605 A 7/1997 Leonaggeo et al.
6,125,670 A 10/2000 Fuss et al.
6,539,755 B1 * 4/2003 Bruwer ..... E05B 47/0012 292/165
6,564,601 B2 5/2003 Hyatt, Jr.
6,732,557 B1 * 5/2004 Zehrung ..... E05B 47/0002 248/671
6,899,361 B2 * 5/2005 Dorn ..... E05B 47/00 292/332
7,520,152 B2 * 4/2009 Sabo ..... E05B 63/18 292/144
7,866,697 B2 1/2011 Norum et al.
8,199,011 B2 * 6/2012 Lu ..... E05B 47/0657 340/542
8,381,558 B2 2/2013 Alef
8,789,398 B2 * 7/2014 Stobbe ..... E05B 47/0607 70/279.1
8,910,499 B2 12/2014 De Franceschi
9,500,007 B2 * 11/2016 Lambrou ..... E05B 47/0673
9,617,757 B2 * 4/2017 Lowder ..... E05B 47/0001
2005/0192932 A1 9/2005 Denison et al.
2009/0229321 A1 9/2009 Eccles et al.
2017/0268256 A1 * 9/2017 Geringer ..... E05B 47/0001

FOREIGN PATENT DOCUMENTS

EP 1566775 A1 8/2005
EP 2050904 B1 9/2012
WO 01/31150 A1 5/2001
WO 2008/094039 A1 8/2008

OTHER PUBLICATIONS

RR Brink Locking Systems; Electromechanical Automatic Deadlocking Latch for Sliding Doors; available online at http://www.rrbrink.com/catalog/5520.pdf; 2016.
Southern Folger; Jamb Mounted for Swinging Doors; available online at http://www.southernfolger.com/10120AM_Motor_Operated_Electro-Mechanical_Deadline.pdf; 2009.
Southern Folger; Jamb Mounted for Swinging Doors; available online at http://www.southernfolger.com/10300M.pdf; 2009.
RR Brink Locking Systems; Function Guide for Motorized Locks; available online at http://www.rrbrink.com/catalog/function_2.pdf; 2016.
RR Brink Locking Systems; Electromechanical Automatic Deadlocking Latch; available online at http://www.allocking.com/downloadfiles/BRINK_valschootslot_3020.pdf; 2016.

* cited by examiner

ELECTROMECHANICAL LOCK WITH MECHANICAL LATCH HOLDBACK AND REMOTE RELEASE

RELATED APPLICATION (PRIORITY CLAIM)

This application claims the benefit of U.S. Provisional Application Ser. No. 62/504,338, filed May 10, 2017, which is hereby incorporated herein by reference in its entirety.

BACKGROUND

The present invention generally relates to electromechanical locks, and more specifically relates to an electromechanical lock which is configured to provide mechanical latch holdback and remote release.

A typical lock which is employed in, for example, correctional facilities (i.e., to secure cell blocks, etc.) is configured to allow a correctional officer to unlock the lock by inserting and rotating a key, causing a latch of the lock to retract and stay retracted even after the guard removes the key. This feature gives a correctional officer the ability to use his key to set one or more doors to an unlocked state for prolonged periods (e.g., during non-lockdown hours). In order to re-lock the lock, the correctional officer is required to re-insert and rotate the key, causing the latch to extend once again, thereby locking the door. The correctional officer must repeat this process for each lock he wants to lock.

SUMMARY

An object of an embodiment of the present invention is to provide an electromechanical lock which is configured to provide not only mechanical latch holdback, but also remote release.

Briefly, an embodiment of the present invention provides an electromechanical lock which is configured to provide a mechanical latch holdback feature, whereby a key is useable to retract a latch of the electromechanical lock, the key can be removed, and the latch remains mechanically held back (i.e., the latch is maintained in the held back or retracted position) such that the lock remains unlocked. The electromechanical lock comprises an internal linkage which provides that the latch which is being mechanically held back is electronically remotely releasable. As such, a correctional officer can use his key to cause the lock to mechanically hold back the latch, such that the lock remains open. Subsequently, a control signal can be sent from a remote location causing the latch to be released and extended, such that the lock locks.

This feature allows a correctional officer at a control center to overcome the mechanical latch holdback and remotely lock doors either individually or severally (i.e., by groups), depending on the wiring logic between the electromechanical lock and the control center. This ability to override the mechanical latch holdback from a control station can be useful in a correctional institution—for example, when the mechanical latch holdback has been engaged for cell doors and an emergency situation arises where a quick remote lockdown may be necessary, instead of having to perform the, still possible but, time-consuming task of re-locking the doors one-by-one, locally by key. The option to remotely relock, singularly or in a group (depending on control circuit logic) may be employed with this feature.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DESCRIPTION OF AN ILLUSTRATED EMBODIMENT

Figure 1:
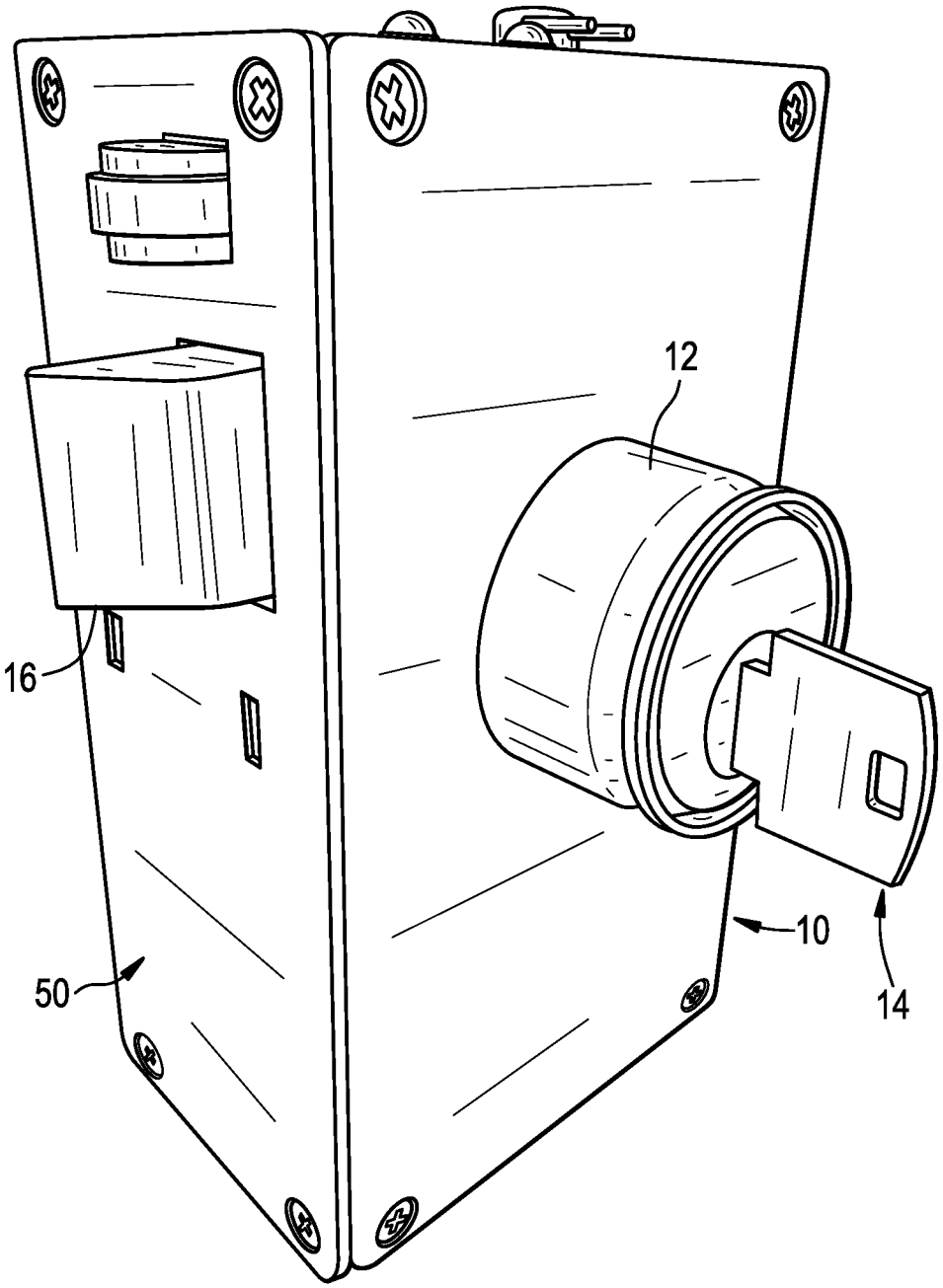
FIG. 1 is an external view of the outside of an electromechanical lock, wherein the electromechanical lock is in accordance with an embodiment of the present invention, and wherein a latch of the lock is extended and a key is inserted into a lock chamber.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

FIG. 1 is an external view of the outside of an electromechanical lock 10, wherein the electromechanical lock 10 is in accordance with an embodiment of the present invention. As shown, the lock 10 comprises a key cylinder 12 which is configured to receive a key 14, as well as a latch 16 which is extendable to lock the lock 10.

Figure 2:
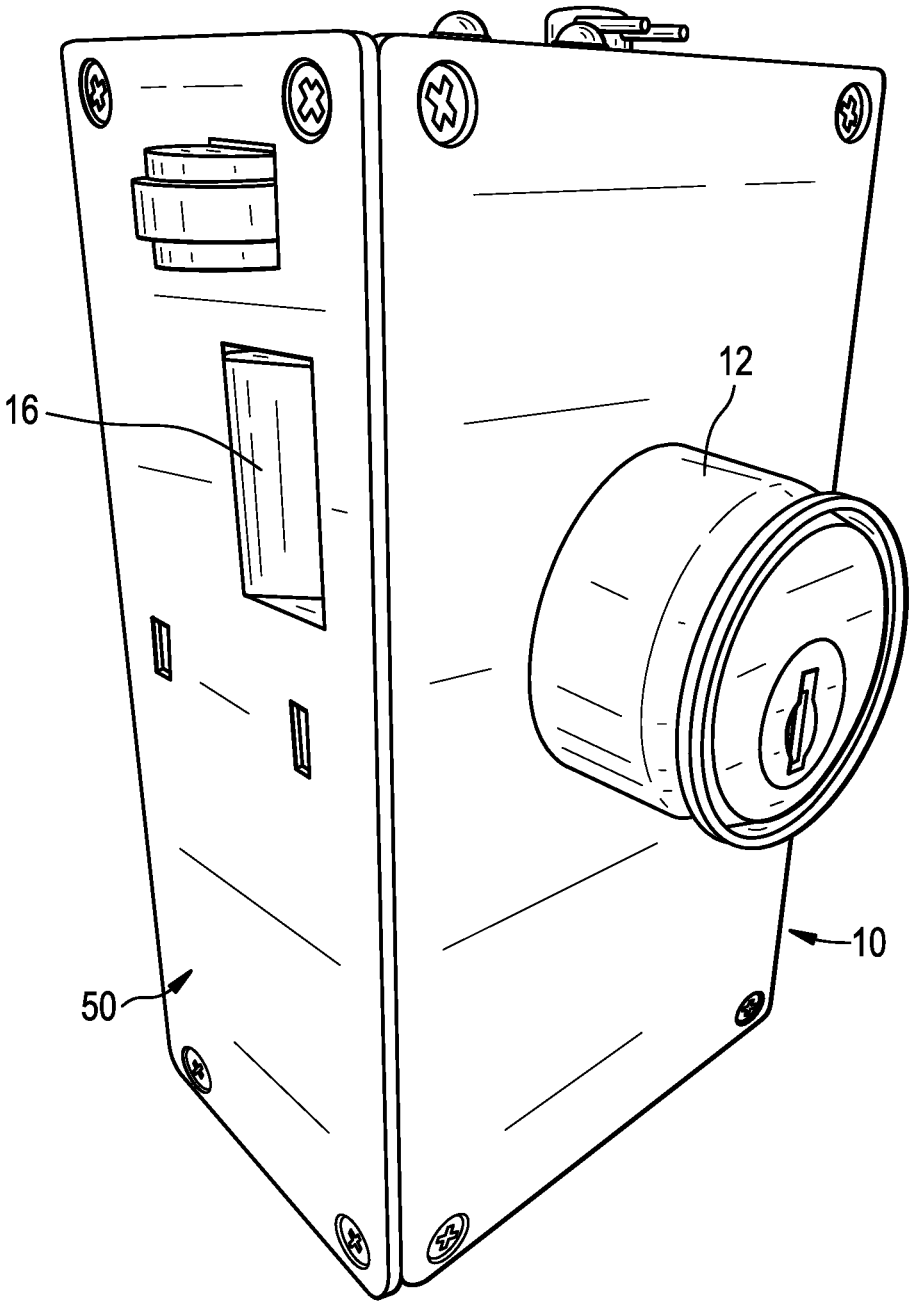
FIG. 2 is a view which is similar to FIG. 1, but shows the lock with the latch retracted and the key having been removed from the lock chamber.

FIG. 2 is a view which is similar to FIG. 1, but shows the lock 10 with the latch 16 retracted (i.e., the lock 10 in the unlocked state) and the key 14 having been removed from the key cylinder 12. As shown in both FIGS. 1 and 2, preferably the latch 16 is beveled which provides that a door (for example) in which the lock 10 is disposed can be closed even though the door is open and the latch 16 is extended.

Figure 3:
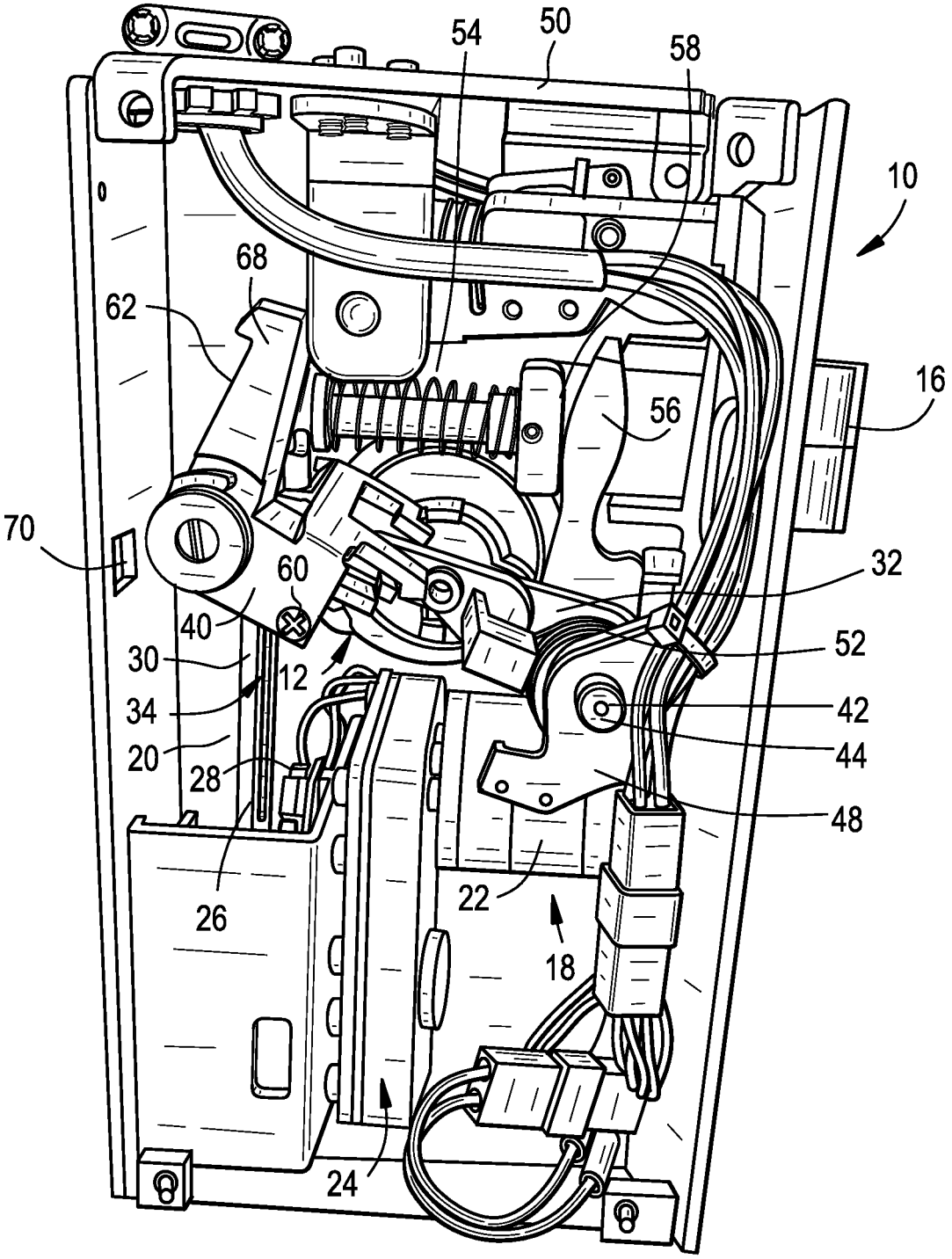
FIG. 3 is a view of the internal components of the electromechanical lock, showing the lock in the locked position (i.e., with the latch extended)
Figure 10:
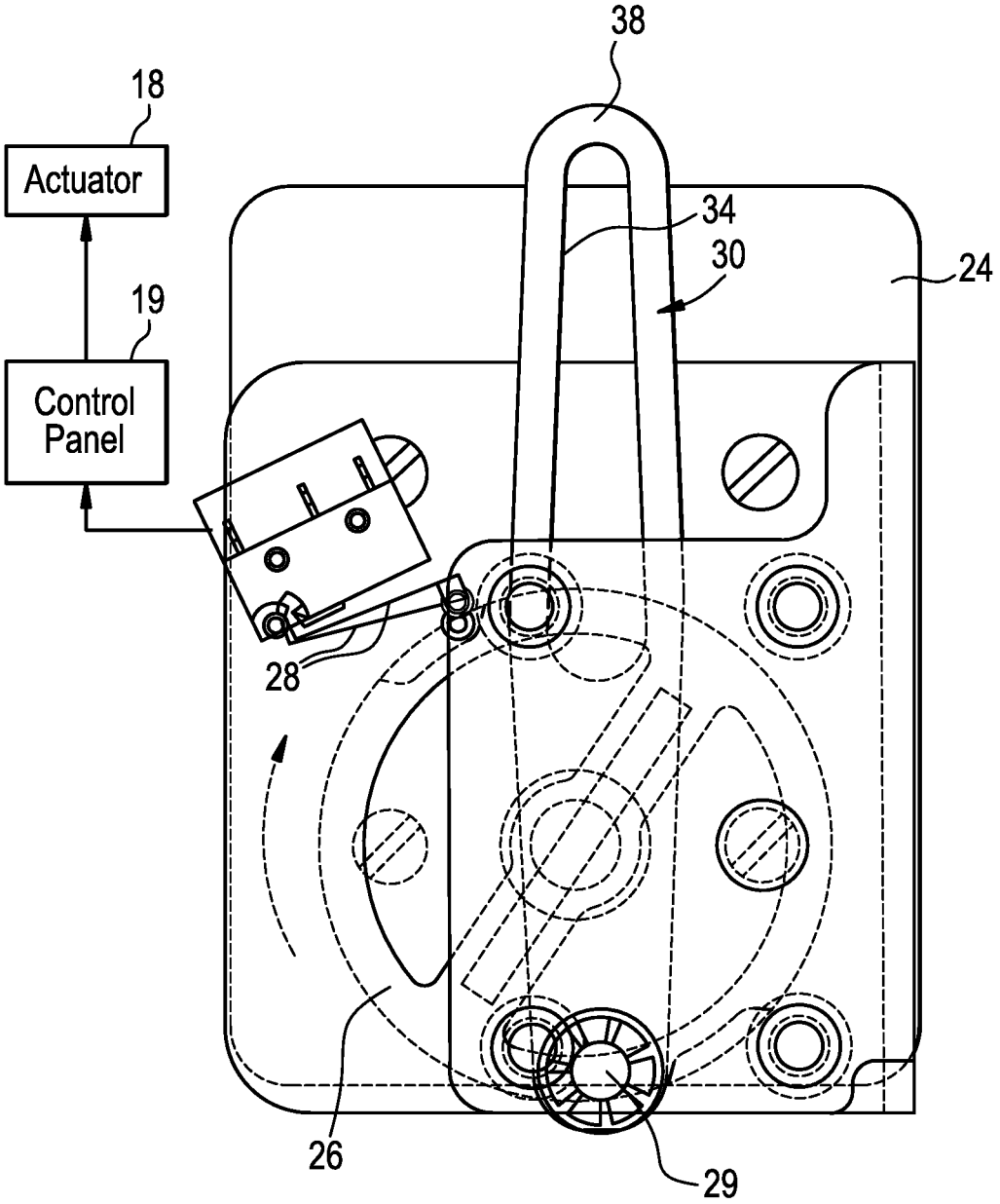
FIG. 10 shows the end of the motor assembly.

FIG. 3 is a view of the internal components of the electromechanical lock 10, showing the lock 10 in the locked position (i.e., with the latch 16 extended). As shown, the lock 10 comprises an actuator 18 and linkage 20 which effectively ultimately links the actuator 18 to the latch 16 such that, while a key 14 can be used to mechanically holdback the latch 16, the latch 16 can nevertheless be released via the actuator 18 as a result of the actuator 18 receiving a signal from a remote source, such as from a control panel 19 (see FIG. 10) in a control center.

The actuator 18 may comprise, for example, an alternating or direct current motor 22 which is coupled to a gearbox 24, which is configured to drive a rotatable member 26 (see, for example, FIG. 10 which shows the end of the motor assembly), such as a disc. Preferably, a pair of switches 28 engage the outer surface of the rotatable member 26 and the switches 28 are in communication with the control panel 19 in the control center such that the rotatable position of the rotatable member 26 can be detected and the control panel 19 can, as a result, decide whether to start, and when to stop, driving the motor 22.

Figure 8:
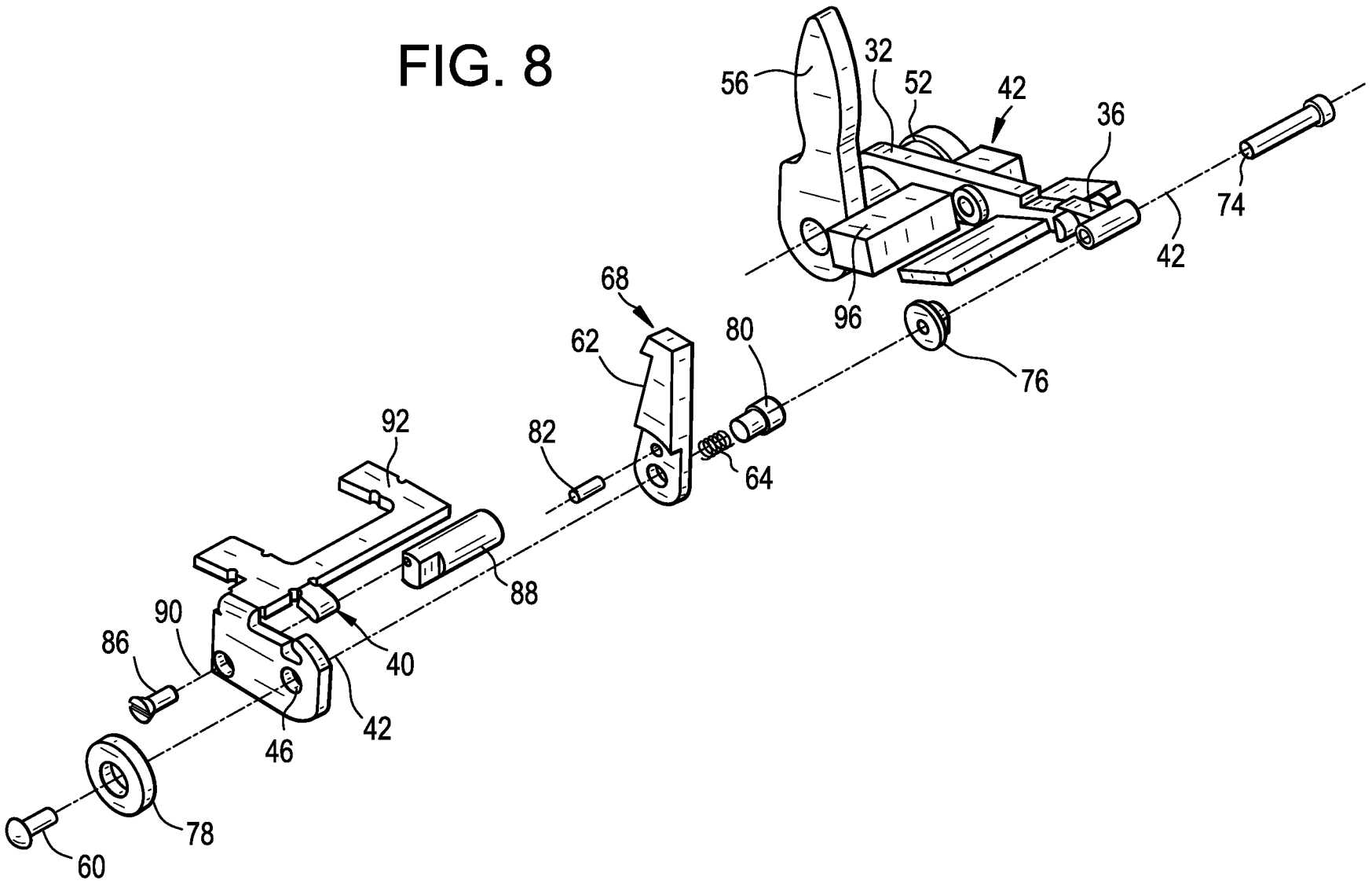
FIG. 8 is an exploded perspective view of some of the internal components of the lock.
Figure 9:
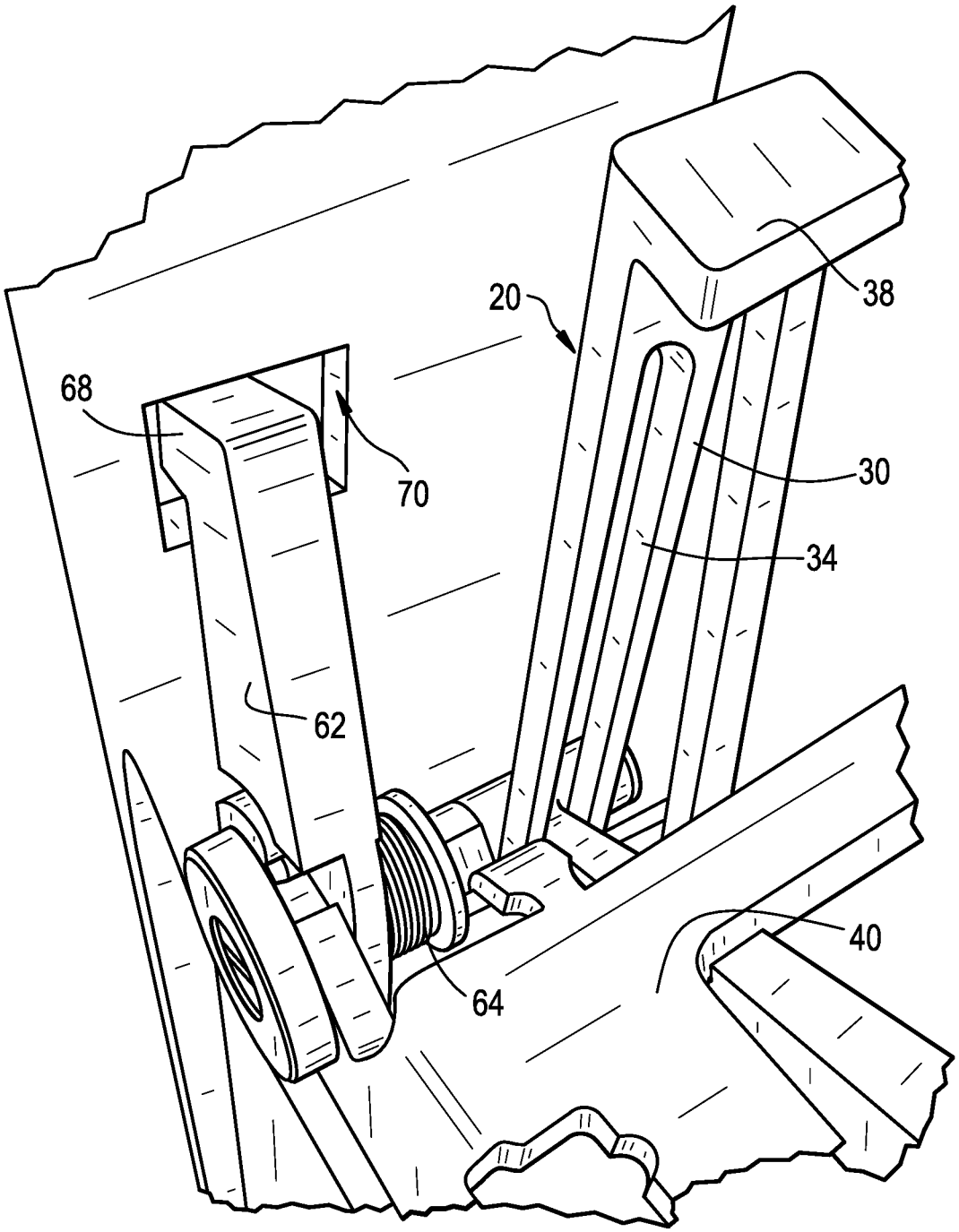
FIG. 9 is a view of the lock, showing a torsion spring thereof.

The rotatable member 26 is preferably linked, via a link point 29, to a link member 30 which is keyed to an operating lever 32. More specifically, preferably the link member 30 has a slot 34 thereon (see FIG. 9) which is effectively linked to the operating lever 32 (i.e., at section 36 as shown in FIG. 8). Preferably, the link member 30 also includes a hook portion 38 at its end which is configured to engage the hold release lever 40, as will be described in more detail later hereinbelow.

As shown in FIG. 3, the operating lever 32 preferably pivots about an axis 42, as a result of a pin 44 which extends through a throughbore 46 (see FIG. 8) provided in the operating lever 32, effectively securing the operating lever 32 to stationary support structure 48. The stationary support structure 48 may comprise a pair of spaced apart walls which are disposed in a housing 50 in which the lock 10 is disposed.

Preferably, a torsion spring 52 is disposed on the operating lever 32 and is configured to bias the operating lever 32 into an up position. A compression spring 54 is preferably provided proximate the latch 16, to spring bias the latch 16 into the extended position. The operating lever 32 preferably comprises an extending finger portion 56 which engages a shoulder 58 on the latch 16, such that the finger 56 can move the latch 16 toward a retracted position, against the force of the compression spring 54.

The operating lever 32 is preferably linked, via a pin 60, to the hold release lever 40 as well as a prop lever 62. Preferably, a torsion spring 64 (see FIG. 9) is disposed on the operating lever 32, wherein one end of the spring 64 engages the operating lever 32 and the other end of the spring 64 engages the prop lever 62, wherein the torsion spring 64 functions to spring bias the hold release lever 40 and prop lever 62 relative to the operating lever 32.

Preferably, the prop lever 62 comprises a hook end portion 68 which is configured to engage in a hole or slot 70 in the housing 50, thereby ultimately providing that the latch 16 is maintained in a hold back position (i.e., retracted).

As discussed above, the lock 10 comprises a key cylinder 12. Specifically, in addition to being configured to receive a key 14, the lock cylinder 12 comprises an internal cam 72 which is selectively rotatable into engagement with either the hold release lever 40 or the operating lever 32, depending on which direction the key 14 is rotated.

Figure 12:
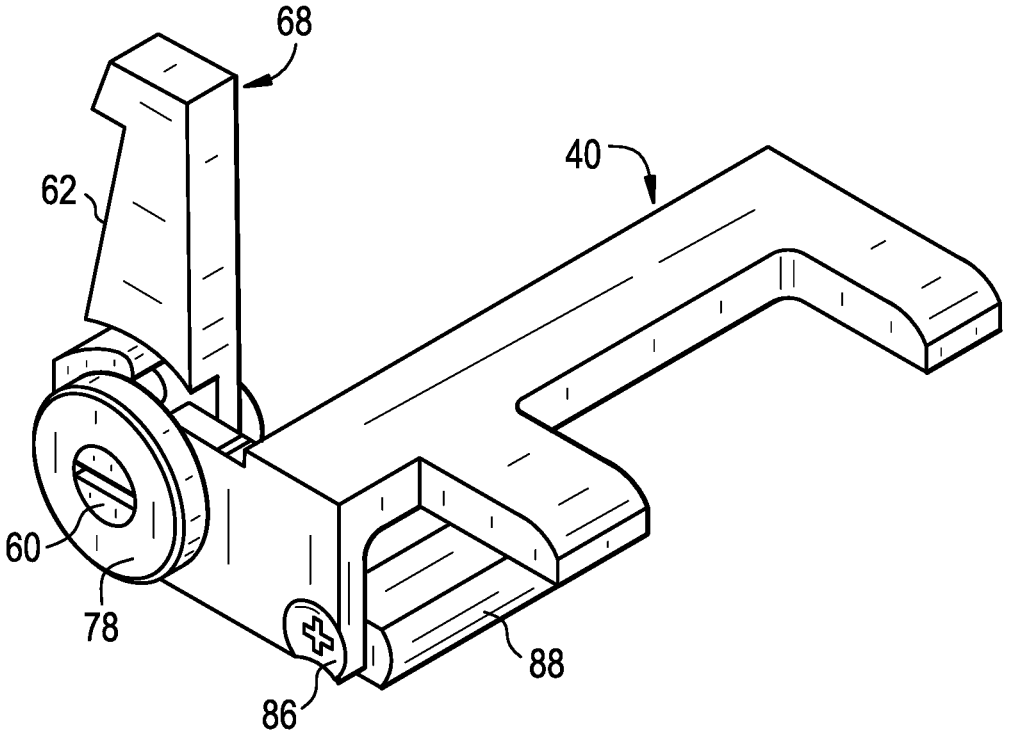
FIG. 12 is a perspective view of a hold release lever/prop lever assembly, which is a part of the lock.
Figure 13:
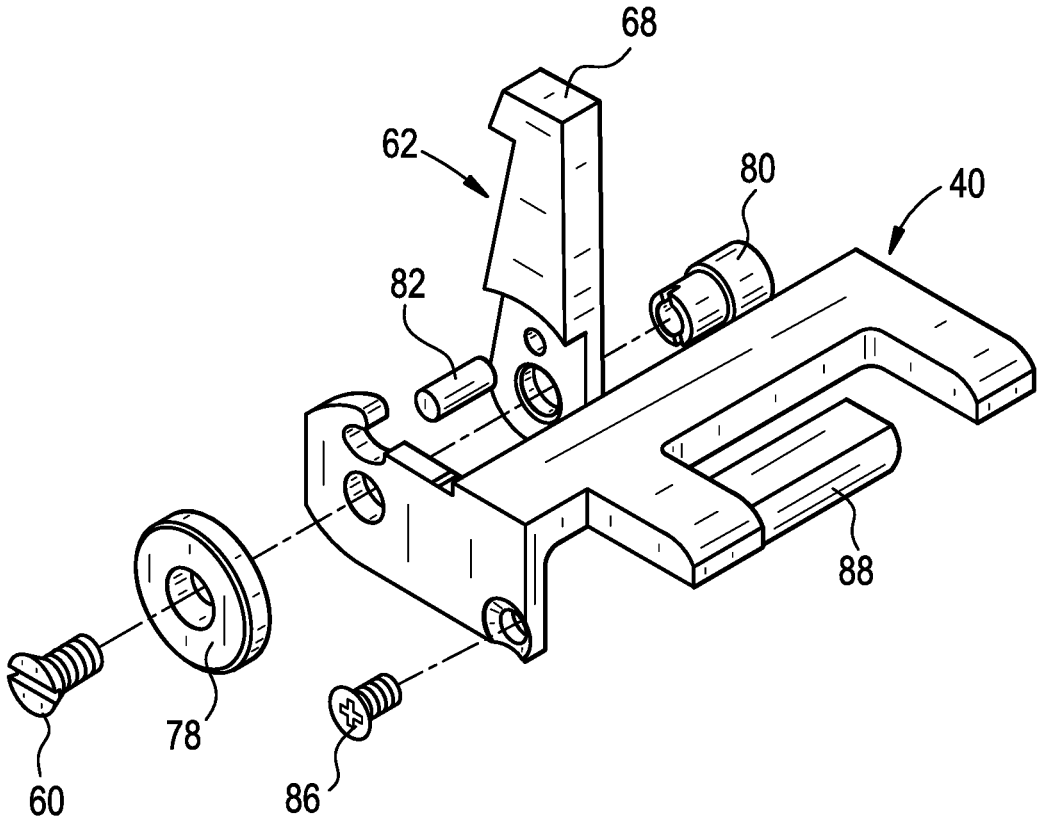
FIG. 13 is similar to FIG. 12, but provides an exploded view.

FIG. 8 is an exploded perspective view of some of the internal components of the lock 10. As shown, additional components include screws 74, a spacer 76, a washer 78, and a mounting pin 80 which collectively couple the hold release lever 40, prop lever 62 and operating lever 32. A roll pin 82 is also included which provides a surface which is engaged by the torsion spring 64. A screw 86 secures an eccentric adjustment pin 88 which functions to contact the underside of the operating lever 32 and limit rotation of the hold release lever 40 relative to the operating lever 32, about axis 90. FIG. 12 is a perspective view showing the hold release lever 40 linked to the prop lever 68 and adjustment pin 88, and FIG. 13 provides the same view, but exploded.

Figure 11:
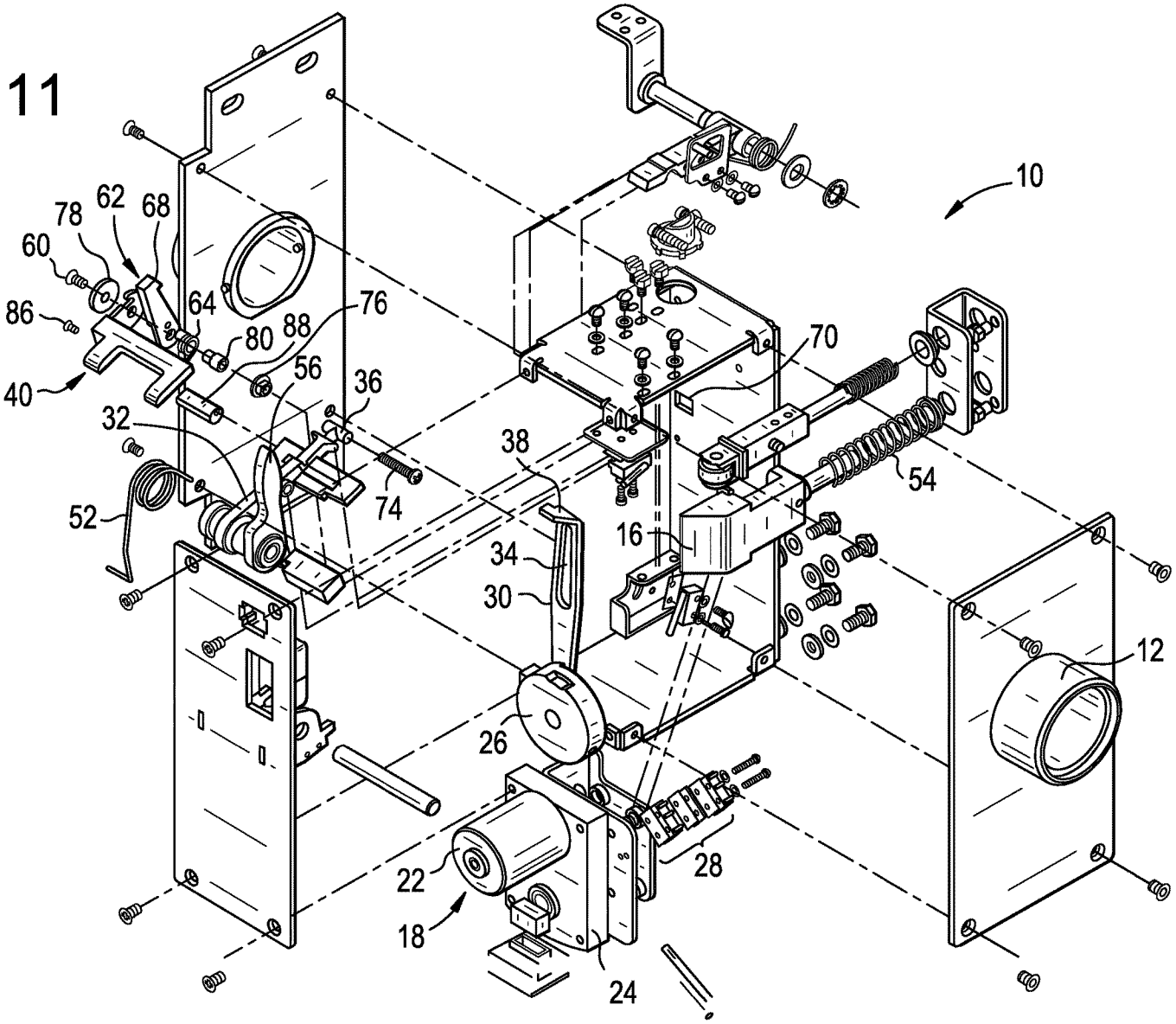
FIG. 11 is an exploded view of the lock.

FIG. 11 provides an exploded view of the lock 10 in general and is self-explanatory given the description herein.

Operation of the electromechanical lock 10, and its various states, will now be described referring to the various Figures.

As discussed above, FIG. 3 shows the lock 10 in the locked state, with the latch 16 extended. In this state, the hook portion 68 of the prop lever 62 is not engaged in the hole or slot 70 in the housing 50, and the compression spring 54 biases the latch 16 into the extended position.

To unlock the lock 10 using the key 14, the key 14 must be inserted into the key cylinder 12 as shown in FIG. 1, and then the key 14 can be rotated in either direction. When the key 14 is rotated in one direction, the lock 10 unlocks (i.e., the latch 16 retracts as shown in FIG. 2) but the latch 16 is not heldback meaning that when the key 14 is rotated back to the neutral position and removed, the latch 16 is again biased into the extended position (as shown in FIG. 1). However, when the key 14 is rotated in the other direction, the lock 10 not only unlocks, but the latch 16 is held back meaning that when the key 14 is rotated back to the neutral position and removed, the latch 16 is held back in the retracted position (as shown in FIG. 2).

Figure 4:
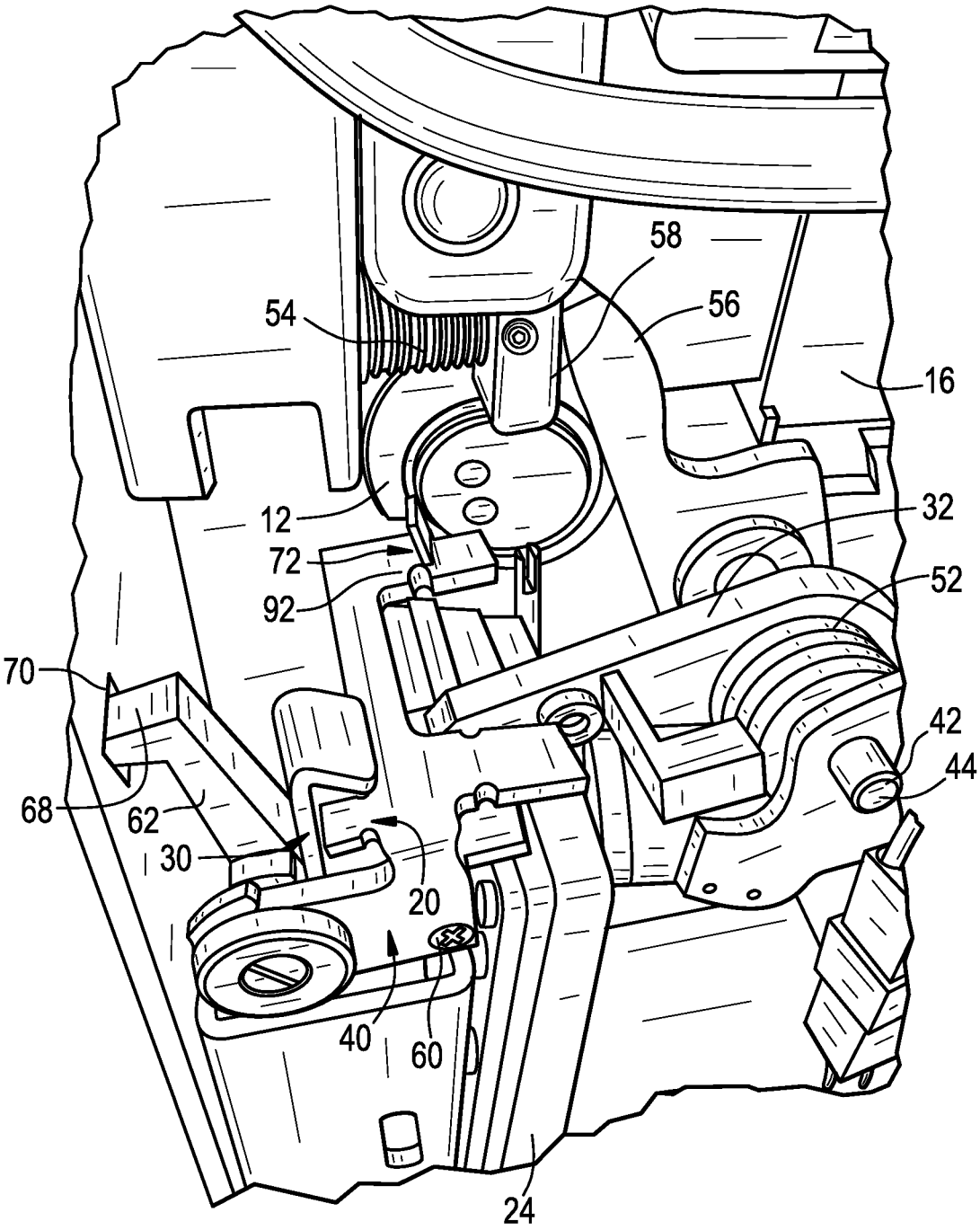
FIG. 4 is a view similar to FIG. 3, but showing the lock being unlocked without latch holdback (i.e., using the key shown in FIG. 1)

The progression from FIG. 3 to FIG. 4 shows the operation of the lock 10 when the key 14 is rotated in the direction which unlocks the lock 10 but does not holdback the latch 16. As shown, rotation of the key 14 in this direction (counterclockwise as shown in FIGS. 3 and 4, clockwise as shown in FIG. 1) causes the cam 72 of the key cylinder 12 to rotate into contact with the hold release lever 40. Specifically, the cam 72 pushes on surface 92 (see FIG. 8) of the hold release lever 40 and this causes the hold release lever 40 to push down on the operating lever 32, causing the operating lever 32 to pivot about axis 42 (in the counterclockwise rotational direction regarding FIGS. 3 and 4). As such, the extending finger portion 56 of the operating lever 32 pushes on the shoulder 58 of the latch 16, against the force of spring 54, causing the latch 16 to retract. When the key 14 has been fully rotated, because the cam 72 remains pushing down on the hold release lever 40, the hook portion 68 of the prop lever 62 does not drop into engagement in the hole or slot 70 in the housing 50. As such, in this state the latch 16 is not held back, meaning that after the key 14 has been rotated such that the cam 72 pushes down on the hold release lever 40 and the latch 16 has been retracted, once the key 14 is released the spring 54 pushes on the latch 16 causing the shoulder 58 of the latch 16 to push on the finger 56 of the operating lever 32 and causing the latch 16 to extend. The pushing on the finger 56 of the operating lever 32 causes the operating lever 32 to rotate back in the other direction about axis 42 (in the clockwise rotational direction regarding FIGS. 3 and 4), causing the hold release lever 40 to move upward and push the cam 72 back to the position shown in FIG. 3, after which time the key 14 can be removed from the key cylinder 12.

Figure 5:
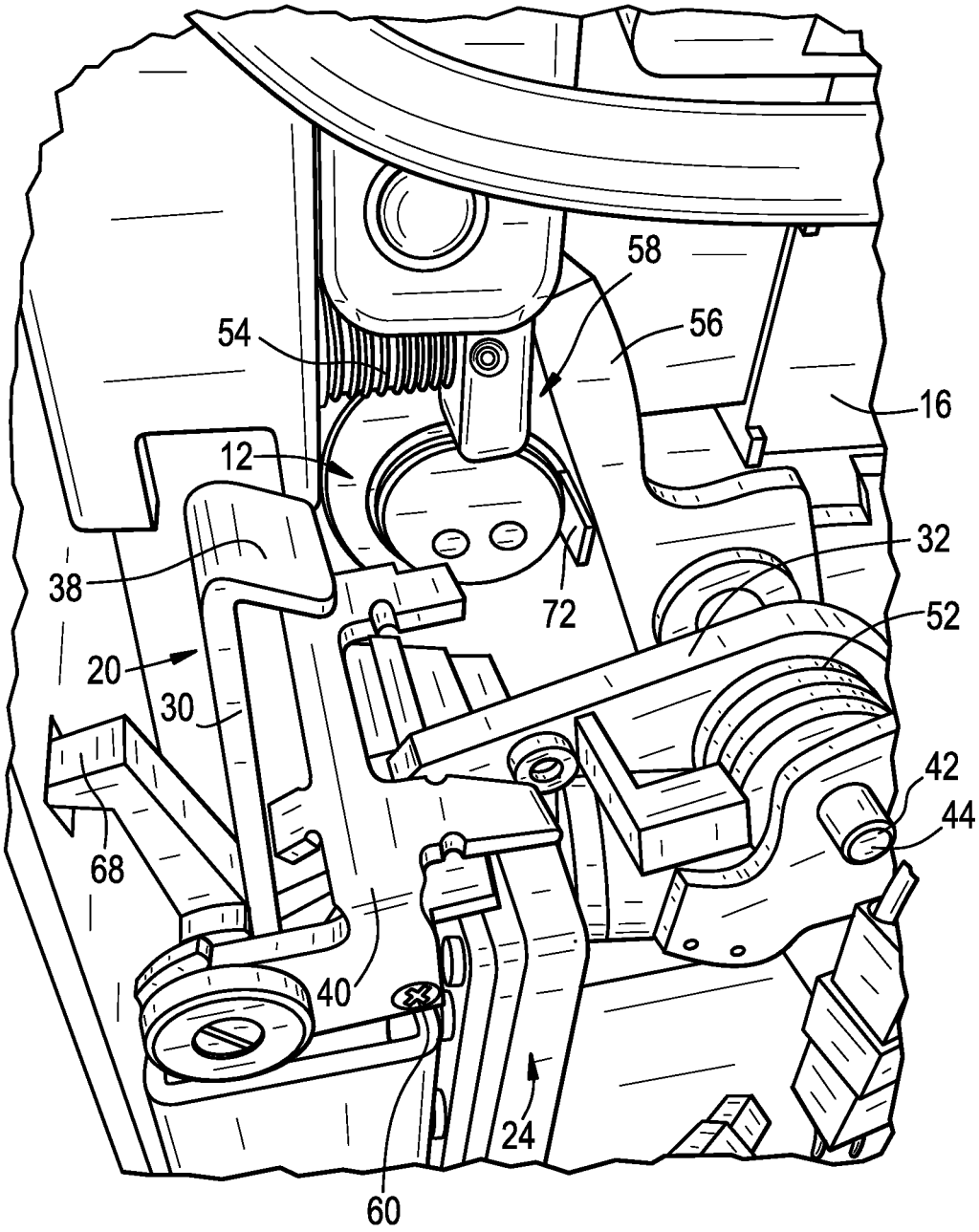
FIG. 5 is a view similar to FIG. 3, but showing the lock being unlocked with latch holdback (i.e., using the key shown in FIG. 1)

The progression from FIG. 3 to FIG. 5 shows the operation of the lock 10 when the key 14 is rotated in the direction which unlocks the lock and holds back the latch 16, meaning that the key 14 can be removed and the latch 16 stays held back in the retracted position. As shown, rotation of the key 14 in this direction (clockwise as shown in FIGS. 3 and 5, counterclockwise as shown in FIG. 1) causes the cam 72 of the key cylinder 12 to rotate into contact with the surface 96 of the operating lever 32 and push down on the operating lever 32 such that the operating lever 32 pivots about axis 42

(in the counter-clockwise rotational direction regarding FIGS. 3 and 5). This causes the finger 56 of the operating lever 32 to push on the shoulder 58 of the latch causing the latch to retract. Additionally, the pivoting of the operating lever 32 about axis 42 causes the operating lever 32 to pull the hold release lever 40 down. Once the hold release lever 40 moves sufficiently downward, the hook portion 68 of the prop lever 62 drops into engagement in the hole or slot 70 in the housing 50, thereby placing the latch 16 in the hold back position. In this state, the key 14 can be rotated in the other direction, into its neutral position, and removed from the key cylinder 12 without causing the latch 16 to extend. The key cylinder 12 can be specifically configured to allow one type of key to unlock the lock, but a require a second, different key to not only unlock the lock, but also engage the latch hold back function.

Figure 6:
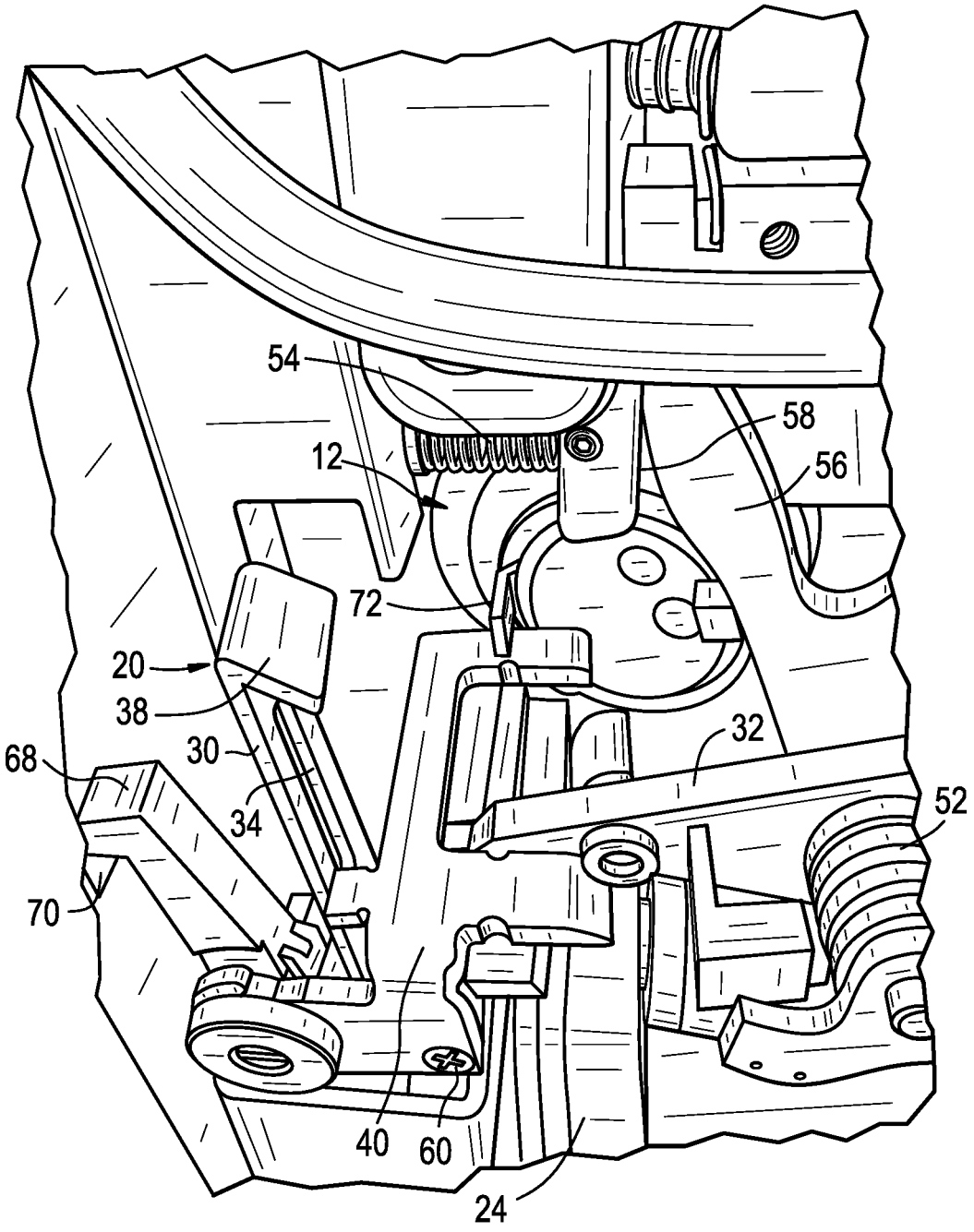
FIGS. 6 and 7 show the latch holdback being released, causing the lock to re-lock, using the key shown in FIG. 1.
Figure 7:
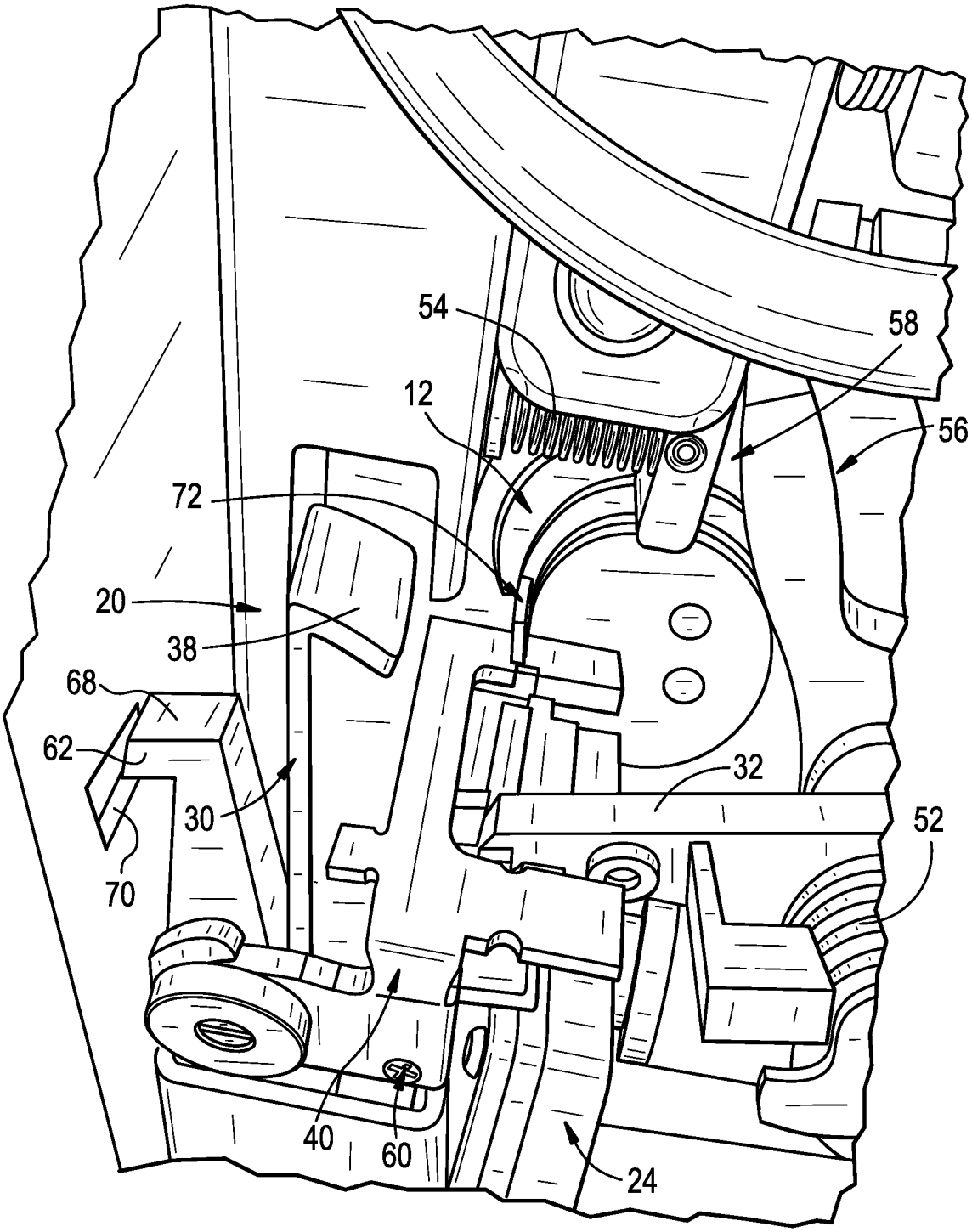

The progression from FIG. 6 to FIG. 7 shows the operation of the lock 10 when the key 14 is rotated in a direction which releases the hold back of the latch 16. As shown, rotation of the key 14 in this direction (counterclockwise as shown in FIGS. 6 and 7, clockwise as shown in FIG. 1) causes the cam 72 of the key cylinder 12 to rotate into contact with the hold release lever 40. Specifically, the cam 72 pushes on surface 92 (see FIG. 8) of the hold release lever 40. This causes the hold release lever 40 to move slightly downward, causing the prop lever 62 to also move slightly downward such that the hook portion 68 of the prop lever 62 disengages from the top surface of the hole 70 in the housing 50, thereby releasing the hook portion 68 of the prop lever 62 from the hole or slot 70 in the housing 50 (i.e., as a result of the torsion spring 64 pivoting the prop lever 62). Thereafter, release of the key 14 causes the spring 54 to push the latch 16 back to the extended position. This causes the shoulder 58 to push on the finger portion 56 of the operating lever 32, causing the operating lever 32 to pivot about axis 42 (in the clockwise rotational direction regarding FIGS. 6 and 7). This pivoting results in surface 92 of the hold release lever 40 pivoting the cam 72 of the key cylinder 12 back to the top position such that the key 14 rotates back to its neutral position at which time the key 14 can be removed.

While the lock 10 is configured such that the key 14 can be used to release the latch 16 from its held back position, the lock 10 is also configured such that the latch 16 can be released remotely via a control panel 19 at a control center, without having to engage a key 14 with the key cylinder 12. To this end, the switches 28 which are in contact with the rotating disc 26 effectively inform the control center whether the lock 10 is in the unlocked or locked state. If the lock 10 is in the locked state and the remote signal is given to unlock the lock 10, the control panel 19 in the control center sends a signal to the lock 10 which causes the motor 22 to start. This causes the motor 22 to drive the gearbox 24 which causes the rotatable disc 26 to rotate. Rotation of the disc 26 causes the link member 30 to pivot downward until a hook portion 38 of the link member 30 contacts and pushes down on the hold release lever 40. This causes the operating lever 32 to be pivot downward as well, and causes the hook portion 68 of the prop lever 62 to move downward and pivot out of engagement with the hole or slot 70 in the housing 50. Further rotation of the disc 26 causes the link member 30 to move upward which causes the torsion spring 52 on the operating lever 32 to pivot the operating lever 32 about axis 42. This causes the finger portion 56 of the operating lever 32 to shift, allowing the compression spring 54 to push the latch 16 back to its extended position.

The lock 10 is also configured such that the latch 16 can be retracted remotely, via the control panel 19 at the control center, without having to use a key 14. To this end, the switches 28 which are in contact with the rotating disc 26 effectively inform the control center whether the lock 10 is in the unlocked or locked state. If the lock 10 is in the unlocked state and the remote signal is given to lock the lock 10, the motor 22 is driven such that the rotatable disc 26 rotates one hundred eighty degrees. This causes the link member 30 to move down and pull the hold release lever 40 downward, causing the operating lever 32 to pivot about axis 42, causing the finger portion 56 of the operating lever 32 to push on the shoulder 58 of the latch 16, thereby driving the latch 16 to the retracted position (see FIG. 2). From this state, the remote signal can subsequently be given to re-lock the lock 10. This causes the motor 22 to be driven such that the rotatable disc 26 rotates another one hundred eighty degrees. This causes the link member 30 to move up and push the hold release lever 40 upward, causing the operating lever 32 to pivot about axis 42, causing the finger portion 56 of the operating lever 32 to pivot, thereby allowing the spring 54 to push the latch 16 back to its extended position (see FIG. 1).

The ability to remotely override the mechanical latch holdback is useful in a correctional facility—for example, when the mechanical latch holdback has been engaged for cell doors and an emergency situation arises where a quick remote lockdown may be necessary, instead of having to perform the time-consuming task of re-locking the doors one-by-one, locally by key.

While a specific embodiment of the invention has been shown and described, it is envisioned that those skilled in the art may devise various modifications without departing from the spirit and scope of the present invention.

What is claimed is:

1. An electromechanical lock which provides a mechanical latch holdback feature, said lock comprising: a latch and internal linkage, wherein the electromechanical lock is configured such that a key is useable to retract the latch of the electromechanical lock, the key can be removed, and the latch remains mechanically held back such that the lock remains unlocked, wherein the internal linkage provides that the latch which is being mechanically held back is electronically remotely releasable to the locked or extended position, further comprising a key cylinder which is configured to receive the key, further comprising an actuator and linkage which links the actuator to the latch such that, while the key can be used to mechanically holdback the latch, the latch can nevertheless be released via the actuator as a result of the actuator receiving a signal, wherein the actuator comprises a motor which is coupled to a gearbox, which is configured to drive a rotatable member, further comprising a pair of switches which engage an outer surface of the rotatable member, wherein the switches are in communication with a control panel such that a rotatable position of the rotatable member can be detected and the control panel can, as a result, decide whether to start, and when to stop, driving the motor.

2. An electromechanical lock as recited in claim 1, further comprising a link member and an operating lever, wherein the rotatable member is linked to the link member which is keyed to the operating lever.

3. An electromechanical lock as recited in claim 2, further comprising a hold release lever, wherein the link member comprises a slot which is linked to the operating lever, wherein the link member comprises a hook portion which engages the hold release lever.

4. An electromechanical lock as recited in claim 3, wherein the operating lever is configured to pivot about an axis as a result of a pin which extends through a throughbore provided in the operating lever, wherein the operating lever is secured to stationary support structure.

5. An electromechanical lock as recited in claim 4, further comprising a torsion spring which is disposed on the operating lever and is configured to bias the operating lever into an up position, and a compression spring proximate the latch to spring bias the latch into an extended position.

6. An electromechanical lock as recited in claim 5, wherein the operating lever comprises an extending finger portion which engages a shoulder on the latch, such that the finger can move the latch toward a retracted position, against the force of the compression spring.

7. An electromechanical lock as recited in claim 6, wherein the operating lever is linked to the hold release lever as well as a prop lever.

8. An electromechanical lock as recited in claim 7, wherein a torsion spring is disposed on the operating lever, wherein one end of the torsion spring engages the operating lever and the other end of the torsion spring engages the prop lever, wherein the torsion spring functions to spring bias the hold release lever and prop lever relative to the operating lever.

9. An electromechanical lock as recited in claim 8, wherein the prop lever comprises a hook end portion which is configured to engage in a hole in a housing, thereby providing that the latch is maintained in a hold back position.

10. An electromechanical lock as recited in claim 9, wherein the key cylinder comprises an internal cam which is selectively rotatable into engagement with either the hold release lever or the operating lever, depending on which direction the key is rotated.

11. An electromechanical lock as recited in claim 10, wherein an eccentric adjustment pin contacts an underside of the operating lever and limits rotation of the hold release lever relative to the operating lever.

12. An electromechanical lock as recited in claim 11, wherein the lock is configured to be in a locked state, wherein the latch is extended and the hook portion of the prop lever is not engaged in the hole in the housing, and the compression spring biases the latch into the extended position, wherein when the key is rotated in one direction, the lock unlocks but the latch is not heldback meaning that when the key is rotated back to the neutral position and removed, the latch is again biased into the extended position, wherein when the key is rotated in the other direction, the lock not only unlocks, but the latch is held back meaning that when the key is rotated back to the neutral position and removed, the latch is held back in the retracted position.

13. An electromechanical lock as recited in claim 12, wherein the lock is configured such that the key is rotatable in a direction which unlocks the lock but does not holdback the latch, wherein rotation of the key in this direction causes the cam of the key cylinder to rotate into contact with the hold release lever, wherein the cam pushes on the hold release lever and this causes the hold release lever to push down on the operating lever, causing the operating lever to pivot, wherein the extending finger portion of the operating lever pushes on the shoulder of the latch, against the force of the spring, causing the latch to retract, wherein when the key has been fully rotated, because the cam remains pushing down on the hold release lever, the hook portion of the prop lever does not drop into engagement in the hole in the housing, wherein in this state the latch is not held back, meaning that after the key has been rotated such that the cam pushes down on the hold release lever and the latch has been retracted, once the key is released the spring pushes on the latch causing the shoulder of the latch to push on the finger of the operating lever and causing the latch to extend, wherein the pushing on the finger of the operating lever causes the operating lever to rotate back in the other direction, causing the hold release lever to move upward and push the cam back to a previous position, after which time the key can be removed from the key cylinder.

14. An electromechanical lock as recited in claim 13, wherein the lock is configured such that operation of the lock when the key is rotated in the direction which unlocks the lock and holds back the latch, meaning that the key can be removed and the latch stays held back in the retracted position, wherein rotation of the key in this direction causes the cam of the key cylinder to rotate into contact with a surface of the operating lever and push down on the operating lever such that the operating lever pivots, causing the finger of the operating lever to push on the shoulder of the latch causing the latch to retract, wherein pivoting of the operating lever causes the operating lever to pull the hold release lever down, wherein once the hold release lever moves sufficiently downward, the hook portion of the prop lever drops into engagement in the hole in the housing, thereby placing the latch in the hold back position, wherein in this state, the key can be rotated in the other direction, into its neutral position, and removed from the key cylinder without causing the latch to extend.

15. An electromechanical lock as recited in claim 14, wherein the lock is configured such that operation of the lock when the key is rotated in a direction which releases the hold back of the latch causes the cam of the key cylinder to rotate into contact with the hold release lever, wherein the cam pushes on the hold release lever, wherein this causes the hold release lever to move downward, causing the prop lever to also move downward such that the hook portion of the prop lever disengages from the top surface of the hole in the housing, thereby releasing the hook portion of the prop lever from the hole in the housing, wherein thereafter release of the key causes the spring to push the latch back to the extended position, wherein this causes the shoulder to push on the finger portion of the operating lever, causing the operating lever to pivot resulting in the hold release lever pivoting the cam of the key cylinder back to a top position such that the key rotates back to its neutral position at which time the key can be removed.

16. An electromechanical lock as recited in claim 15, wherein the lock is configured such that the key can be used to release the latch from its held back position, wherein the lock is also configured such that the latch can be released remotely via a control panel, without having to engage a key with the key cylinder, wherein if the lock is in the locked state and a remote signal is given to unlock the lock, a signal is received by the lock which causes the motor to start, wherein this causes the motor to drive the gearbox which causes the rotatable member to rotate, wherein rotation of the rotatable member causes the link member to pivot downward until a hook portion of the link member contacts and pushes down on the hold release lever, wherein this causes the operating lever to pivot downward, and causes the hook portion of the prop lever to move downward and pivot out of engagement with the hole in the housing, wherein further rotation of the rotatable member causes the link member to move upward which causes the torsion spring on the operating lever to pivot the operating lever, wherein this causes the finger portion of the operating lever to shift, allowing the compression spring to push the latch back to its extended position, wherein the lock is also configured such that the latch can be retracted remotely, via a control panel, without having to use a key, wherein if the lock is in the unlocked state and a remote signal is given to lock the lock, the motor is driven such that the rotatable member rotates causing the link member to move down and pull the hold release lever downward, causing the operating lever to pivot about axis, causing the finger portion of the operating lever to push on the shoulder of the latch, thereby driving the latch to the retracted position, wherein from this state, the remote signal can subsequently be given to re-lock the lock causing the motor to be driven such that the rotatable member rotates again causing the link member to move up and push the hold release lever upward, causing the operating lever to pivot causing the finger portion of the operating lever to pivot, thereby allowing the spring to push the latch back to its extended position.

17. An electromechanical lock which provides a mechanical latch holdback feature, said lock comprising: a latch and internal linkage, wherein the electromechanical lock is configured such that a key is useable to retract the latch of the electromechanical lock, the key can be removed, and the latch remains mechanically held back such that the lock remains unlocked, wherein the internal linkage provides that the latch which is being mechanically held back is electronically remotely releasable to the locked or extended position, wherein the internal linkage comprises an actuator which releases the latch, wherein the actuator comprises a rotatable member, further comprising switches which detect the rotatable position of the rotating member.

18. An electromechanical lock as recited in claim 17, wherein the rotatable member is rotated by the actuator depending on the rotatable position of the rotating member which is detected by the switches.

19. An electromechanical lock which provides a mechanical latch holdback feature, said lock comprising: a latch and internal linkage, wherein the electromechanical lock is configured such that a key is useable to retract the latch of the electromechanical lock, the key can be removed, and the latch remains mechanically held back such that the lock remains unlocked, wherein the internal linkage provides that the latch which is being mechanically held back is electronically remotely releasable to the locked or extended position, further comprising a key cylinder which is configured to receive the key, further comprising an actuator and linkage which links the actuator to the latch such that, while the key can be used to mechanically holdback the latch, the latch can nevertheless be released via the actuator as a result of the actuator receiving a signal, wherein the actuator comprises a motor which is coupled to a gearbox, which is configured to drive a rotatable member, further comprising a link member and an operating lever, wherein the rotatable member is linked to the link member which is keyed to the operating lever, further comprising a hold release lever, wherein the link member comprises a slot which is linked to the operating lever, wherein the link member comprises a hook portion which engages the hold release lever.

20. An electromechanical lock as recited in claim 19, wherein the operating lever is configured to pivot about an axis as a result of a pin which extends through a throughbore provided in the operating lever, wherein the operating lever is secured to stationary support structure.

21. An electromechanical lock as recited in claim 20, further comprising a torsion spring which is disposed on the operating lever and is configured to bias the operating lever into an up position, and a compression spring proximate the latch to spring bias the latch into an extended position.

22. An electromechanical lock as recited in claim 21, wherein the operating lever comprises an extending finger portion which engages a shoulder on the latch, such that the finger can move the latch toward a retracted position, against the force of the compression spring.

23. An electromechanical lock as recited in claim 22, wherein the operating lever is linked to the hold release lever as well as a prop lever.

24. An electromechanical lock as recited in claim 23, wherein a torsion spring is disposed on the operating lever, wherein one end of the torsion spring engages the operating lever and the other end of the torsion spring engages the prop lever, wherein the torsion spring functions to spring bias the hold release lever and prop lever relative to the operating lever.

25. An electromechanical lock as recited in claim 24, wherein the prop lever comprises a hook end portion which is configured to engage in a hole in a housing, thereby providing that the latch is maintained in a hold back position.

26. An electromechanical lock as recited in claim 25, wherein the key cylinder comprises an internal cam which is selectively rotatable into engagement with either the hold release lever or the operating lever, depending on which direction the key is rotated.

27. An electromechanical lock as recited in claim 26, wherein an eccentric adjustment pin contacts an underside of the operating lever and limits rotation of the hold release lever relative to the operating lever.

28. An electromechanical lock as recited in claim 27, wherein the lock is configured to be in a locked state, wherein the latch is extended and the hook portion of the prop lever is not engaged in the hole in the housing, and the compression spring biases the latch into the extended position, wherein when the key is rotated in one direction, the lock unlocks but the latch is not heldback meaning that when the key is rotated back to the neutral position and removed, the latch is again biased into the extended position, wherein when the key is rotated in the other direction, the lock not only unlocks, but the latch is held back meaning that when the key is rotated back to the neutral position and removed, the latch is held back in the retracted position.

29. An electromechanical lock as recited in claim 28, wherein the lock is configured such that the key is rotatable in a direction which unlocks the lock but does not holdback the latch, wherein rotation of the key in this direction causes the cam of the key cylinder to rotate into contact with the hold release lever, wherein the cam pushes on the hold release lever and this causes the hold release lever to push down on the operating lever, causing the operating lever to pivot, wherein the extending finger portion of the operating lever pushes on the shoulder of the latch, against the force of the spring, causing the latch to retract, wherein when the key has been fully rotated, because the cam remains pushing down on the hold release lever, the hook portion of the prop lever does not drop into engagement in the hole in the housing, wherein in this state the latch is not held back, meaning that after the key has been rotated such that the cam pushes down on the hold release lever and the latch has been retracted, once the key is released the spring pushes on the latch causing the shoulder of the latch to push on the finger of the operating lever and causing the latch to extend, wherein the pushing on the finger of the operating lever causes the operating lever to rotate back in the other direction, causing the hold release lever to move upward and push the cam back to a previous position, after which time the key can be removed from the key cylinder.

30. An electromechanical lock as recited in claim 29, wherein the lock is configured such that operation of the lock when the key is rotated in the direction which unlocks the lock and holds back the latch, meaning that the key can be removed and the latch stays held back in the retracted position, wherein rotation of the key in this direction causes the cam of the key cylinder to rotate into contact with a surface of the operating lever and push down on the operating lever such that the operating lever pivots, causing the finger of the operating lever to push on the shoulder of the latch causing the latch to retract, wherein pivoting of the operating lever causes the operating lever to pull the hold release lever down, wherein once the hold release lever moves sufficiently downward, the hook portion of the prop lever drops into engagement in the hole in the housing, thereby placing the latch in the hold back position, wherein in this state, the key can be rotated in the other direction, into its neutral position, and removed from the key cylinder without causing the latch to extend.

31. An electromechanical lock as recited in claim 30, wherein the lock is configured such that operation of the lock when the key is rotated in a direction which releases the hold back of the latch causes the cam of the key cylinder to rotate into contact with the hold release lever, wherein the cam pushes on the hold release lever, wherein this causes the hold release lever to move downward, causing the prop lever to also move downward such that the hook portion of the prop lever disengages from the top surface of the hole in the housing, thereby releasing the hook portion of the prop lever from the hole in the housing, wherein thereafter release of the key causes the spring to push the latch back to the extended position, wherein this causes the shoulder to push on the finger portion of the operating lever, causing the operating lever to pivot resulting in the hold release lever pivoting the cam of the key cylinder back to a top position such that the key rotates back to its neutral position at which time the key can be removed.

32. An electromechanical lock as recited in claim 31, wherein the lock is configured such that the key can be used to release the latch from its held back position, wherein the lock is also configured such that the latch can be released remotely via a control panel, without having to engage a key with the key cylinder, wherein if the lock is in the locked state and a remote signal is given to unlock the lock, a signal is received by the lock which causes the motor to start, wherein this causes the motor to drive the gearbox which causes the rotatable member to rotate, wherein rotation of the rotatable member causes the link member to pivot downward until a hook portion of the link member contacts and pushes down on the hold release lever, wherein this causes the operating lever to pivot downward, and causes the hook portion of the prop lever to move downward and pivot out of engagement with the hole in the housing, wherein further rotation of the rotatable member causes the link member to move upward which causes the torsion spring on the operating lever to pivot the operating lever, wherein this causes the finger portion of the operating lever to shift, allowing the compression spring to push the latch back to its extended position, wherein the lock is also configured such that the latch can be retracted remotely, via a control panel, without having to use a key, wherein if the lock is in the unlocked state and a remote signal is given to lock the lock, the motor is driven such that the rotatable member rotates causing the link member to move down and pull the hold release lever downward, causing the operating lever to pivot about axis, causing the finger portion of the operating lever to push on the shoulder of the latch, thereby driving the latch to the retracted position, wherein from this state, the remote signal can subsequently be given to re-lock the lock causing the motor to be driven such that the rotatable member rotates again causing the link member to move up and push the hold release lever upward, causing the operating lever to pivot causing the finger portion of the operating lever to pivot, thereby allowing the spring to push the latch back to its extended position.

* * * * *